United States Patent [19]

Stahly

[11] 3,961,513

[45] June 8, 1976

[54] METHOD OF MAKING PIPE FITTINGS

[75] Inventor: H. La Mar Stahly, Noppanee, Ind.

[73] Assignee: Elkhart Products Corporation, Elkhart, Ind.

[22] Filed: Apr. 11, 1975

[21] Appl. No.: 567,424

[52] U.S. Cl. ..... 72/58; 29/157.6
[51] Int. Cl.[2] ..... B21D 51/16
[58] Field of Search ..... 29/157.6, 157 R; 72/57, 72/58, 60, 61

[56] References Cited

UNITED STATES PATENTS

| | | | |
|---|---|---|---|
| 2,198,643 | 4/1940 | Wendell et al. | 72/58 |
| 2,238,212 | 4/1941 | Cornell | 72/58 |
| 2,858,787 | 1/1958 | Hill | 72/58 |
| 3,225,423 | 12/1965 | Huet | 29/157.6 |
| 3,681,960 | 8/1972 | Tadokoro | 29/157 |

FOREIGN PATENTS OR APPLICATIONS

| | | | |
|---|---|---|---|
| 472,352 | 3/1951 | Canada | 72/57 |

*Primary Examiner*—Lowell A. Larson
*Attorney, Agent, or Firm*—Dawson, Tilton, Fallon & Lungmus

[57] ABSTRACT

A method of making a pipe fitting having a generally T-shape wherein a solid plug of malleable metal is first deformed to provide a tube closed at one end and having a thicker wall adjacent the closed end and thereafter further deforming the tube to provide a pair of legs adjacent the one end.

3 Claims, 14 Drawing Figures

FIG. 1
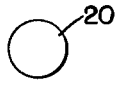
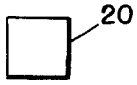
FIG. 2
FIG. 3
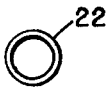
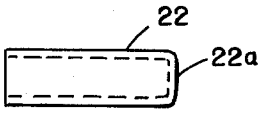
FIG. 4
FIG. 5
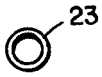
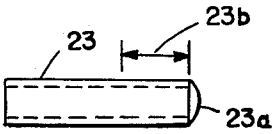
FIG. 6
FIG. 7
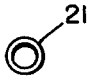
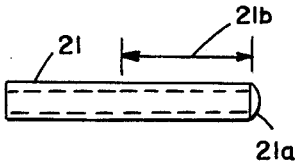
FIG. 8
FIG. 9
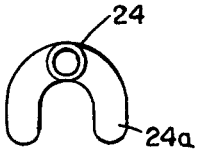
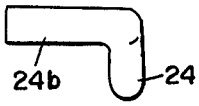
FIG. 10
FIG. 11
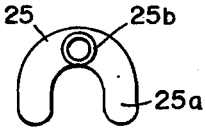
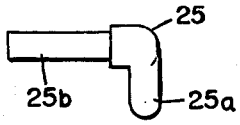
FIG. 12
FIG. 13
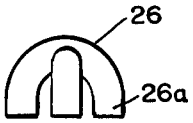
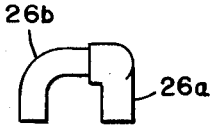
FIG. 14

METHOD OF MAKING PIPE FITTINGS

BACKGROUND AND SUMMARY OF INVENTION

This invention relates to a method of making a pipe fitting and, more particularly, to a fitting having a generally T-shape. In equipment using coils (either for heating or cooling), it has been the practice to utilize return bends to connect various rungs of piping and, in some instances a generally T-shaped fitting to connect three pipes or tubes, the T-shaped fitting approximating the appearance of a tripod. The simplest way of making such a tripod fitting was to braze an ell to a return bend or U-shaped fitting. However, this procedure resulted in many tripods which were faulty, particularly at the line of union. It was therefore felt that a superior product could be achieved through extruding or swaging a unitary piece in accordance with the well known procedure set forth in a Seeber et al U.S. Pat. No. 2,111,695 or utilizing hydraulic fluid as taught in Tadokoro U.S. Pat. No. 3,681,960. Use of these prrocedures resulted in an unsatisfactory product characterized by bursting, imperfect walls or wrinkling.

I have found that a suitable tripod fitting can be fabricated so as to have the benefit of a unitary fitting, i.e., no burrs at the joint to impede flow, through the use of a procedure wherein a solid plug or capsule of malleable metal is cold-worked or deformed to provide a tube closed at one end and further characterized by having a wall thickness adjacent that end greater than the wall thickness remote therefrom; and thereafter further deforming the tube to provide a pair of legs, i.e., a return bend adjacent that one end.

Other objects and advantages of the invention may be seen in the ensuring specification.

DETAILED DESCRIPTION

The invention is described in conjunction with the accompanying drawing, in which FIGS. 1 and 2 are, respectively, an end and side elevational view of the starting plug or capsule of malleable metal such as aluminum, copper, etc.;

FIGS. 3 and 4 are, respectively, end and side elevational views of the work piece or blank after it has been initially deformed;

FIGS. 5 and 6 are, respectively, end and side elevational views in a subsequent stage of the first cold working;

FIGS. 7 and 8 are, respectively, end and side elevational views of the tube after it has had the first cold working step performed on it;

FIGS. 9 and 10 are, respectively, end and side elevational views of the blank after it has been subjected to the second cold working step;

FIGS. 11 and 12 are, respectively, end and side elevational views after further swaging of the work piece of FIGS. 9 and 10; and FIGS. 13 and 14 are, respectively, end and side elevational views of the completed tripod.

In the illustration given, and with particular reference to FIGS. 1 and 2, the numeral 20 designates the beginning plug or capsule which may be advantageously constructed of solid copper wire or aluminum wire No. 1200 and which, in one embodiment of the invention, can be dimensioned 1 inch in diameter by 1 inch long. This plug 20 is subjected to cold working in a first general step which will result in a tube closed at one end such as is designated by the numeral 21 in FIGS. 7 and 8.

To proceed from the showing of FIGS. 1 and 2 to that of FIGS. 7 and 8, a series of sub-steps are performed. Initially, the plug 20 is subjected to cold working or deforming commonly referred to as an "extrusion" to develop a relatively thin wall elongated tube of the nature designated 22 in FIGS. 3 and 4. Such an extrusion operation can be performed on a variety of machines, one such machine being seen in Arbogast U.S. Pat. 3,210,984.

Following the first extrusion, the tube 22 is subjected to further cold forming while still retaining its tubular shape. In FIGS. 5 and 6, the numeral 23 designates the tube after its diameter has been somewhat reduced — resulting in tubular elongation and while still retaining the closed end as at 23*a*, corresponding to the end 22*a* of FIG. 4. The elongation characteristic of the transformation of the tube 22 of FIGS. 3 and 4 to the tube 23 of FIGS. 5 and 6 is advantageously achieved through swaging. The swaging tool is so constructed or contoured to provide a portion of the tube in the segment designated 23*b* of a somewhat greater wall thickness than the remainder of the tube, i.e., the portion of the tube remote from the end 23*a*. Optimally, the thickness differential is of the order of 0.010 inch. The enthickened length 23*b* in the illustration given, i.e., to result in a tripod having a return bend of 1 inch centers, is of the order of ½inch. Thereafter a second swaging is performed to develop the tube previously designated 21 in FIGS. 7 and 8. At this juncture, the tube diameter is of the order of 7/16 inch with the enthickened length 21*b* (adjacent the end 21*a*), being of the order of 1 inch. The wall thickness in this region 21*b* is approximately 0.070 inch with the remainder of the tube length having a thickness of the order of 0.060 inch.

The next step performed on the tube 21 is the second cold working step which again is advantageously an extrusion to result in the structure designated 24 in FIGS. 9 and 10. This is advantageously achieved through apparatus of the type previously referred to in the Seeber and Tadokoro patents wherein upper and lower dies are contoured to provide a recess or cavity sized to receive the tube 21. Additionally, the dies are provided with relief zones to permit the development of the legs 24*a* (see FIG. 9). Thus, one of the dies will have a much deeper relief zone to permit the metal to flow therein under the influence of the cold working. Cold working is advantageously achieved through the introduction of pressurized hydraulic fluid using a ram or the like to provide the legs 24*a* from the enthickened portion 21*b*. Thereafter, a further swaging operation can be employed to reduce the diameter of the remaining leg 24*b* to that designated 25*b* in the fitting designated 25 in FIGS. 11 and 12. The return bend forming legs in FIGS. 11 and 12 are designated by the numeral 25*a*.

The last portion of the procedure involves bending the leg 25*b* of FIG. 12 for example into the configuration designated 26*b* in FIG. 14. The fitting 26 of FIGS. 13 and 14 further differ from the showing in FIGS. 11 and 12 by virtue of the ends of the legs 25*a* being severed (to provide the leg 26*a* as seen in FIGS. 13 and 14).

I have found that utilizing the procedure above-given wherein the first tube forming step is characterized by providing an enthickened portion adjacent the closed end of the tube results in a tripod fitting characterized by uniform strength and integrity when brought about the extrusion step characterized by the structure of FIGS. 9 and 10.

Although a detailed description has been given of an illustrated embodiment of the invention, those skilled in the art will appreciate that the details hereof may be varied widely while still remaining within the spirit and scope of the invention.

I claim:

1. A method for producing a wrought fitting having three legs arranged in a generally T-shape comprising the steps of:

cold deforming a solid plug of malleable metal to provide a tube closed at one end and having a tube wall thickness adjacent said one end greater than the tube wall thickness remote from said one end, confining said tube in die means having relief zones on each side of said tube adapted to develop curved legs extending from the sides of said tube, further deforming said tube in a single step by utilizing a ram to extrude said tube while internally pressurizing said tube with fluid to provide a pair of curved legs adjacent said one end, and severing the ends of said legs.

2. The method of claim 1 in which the differential thickness in the tube wall is of the order of 0.010 inch.

3. The method of claim 1 in which said tube is thereafter curved in the portion remote from said one end to provide a tripod-like configuration.

* * * * *